US008126118B2

(12) United States Patent
Hauttmann

(10) Patent No.: US 8,126,118 B2
(45) Date of Patent: Feb. 28, 2012

(54) X-RAY TUBE AND METHOD OF VOLTAGE SUPPLYING OF AN ION DEFLECTING AND COLLECTING SETUP OF AN X-RAY TUBE

(75) Inventor: Stefan Hauttmann, Buchholz (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/376,442

(22) PCT Filed: Jul. 26, 2007

(86) PCT No.: PCT/IB2007/052972

§ 371 (c)(1), (2), (4) Date: Feb. 5, 2009

(87) PCT Pub. No.: WO2008/017982

PCT Pub. Date: Feb. 14, 2008

(65) Prior Publication Data

US 2010/0177874 A1 Jul. 15, 2010

(30) Foreign Application Priority Data

Aug. 10, 2006 (EP) ..... 06118712

(51) Int. Cl.
*H01J 35/30* (2006.01)

(52) U.S. Cl. ..... 378/137; 378/138

(58) Field of Classification Search ..... 378/137–138
See application file for complete search history.

(56) References Cited

U.S. PATENT DOCUMENTS

| | | | | |
|---|---|---|---|---|
| 3,691,417 | A | 9/1972 | Gralenski | |
| 4,521,900 | A | 6/1985 | Rand | |
| 4,625,150 | A | 11/1986 | Rand | |
| 5,125,019 | A | 6/1992 | Evain et al. | |
| 5,193,105 | A | 3/1993 | Rand et al. | |
| 5,200,645 | A * | 4/1993 | Laeuffer | 307/82 |
| 5,343,112 | A | 8/1994 | Wegmann et al. | |
| 5,521,900 | A | 5/1996 | Ando et al. | |
| 5,616,920 | A | 4/1997 | Plies | |
| 6,128,367 | A * | 10/2000 | Foerst et al. | 378/137 |
| 6,208,711 | B1 | 3/2001 | Rand et al. | |
| 2008/0095317 | A1 * | 4/2008 | Lemaitre | 378/138 |

FOREIGN PATENT DOCUMENTS

| | | | |
|---|---|---|---|
| DE | 10020266 | A1 | 11/2001 |
| EP | 1415595 | A1 | 5/2004 |
| GB | 2109156 | A | 5/1983 |
| JP | 57049153 | A | 3/1982 |

* cited by examiner

*Primary Examiner* — Hoon Song

(57) ABSTRACT

The invention relates to an X-ray tube with a cathode, generating an electron beam, and an ion-deflecting and collecting setup (IDC), consisting of a single pair of electrodes, wherein the first electrode has a positive supply and the second electrode has either an actively or a passively generated negative voltage, compared to ground potential. Further, the invention relates to a method of voltage supplying of a deflecting and collecting setup (IDC) consisting of a single pair of electrode, wherein the first electrode has a positive voltage potential and the second electrode has either an actively or a passively generated negative voltage, compared to ground potential.

26 Claims, 6 Drawing Sheets

Figure 1:
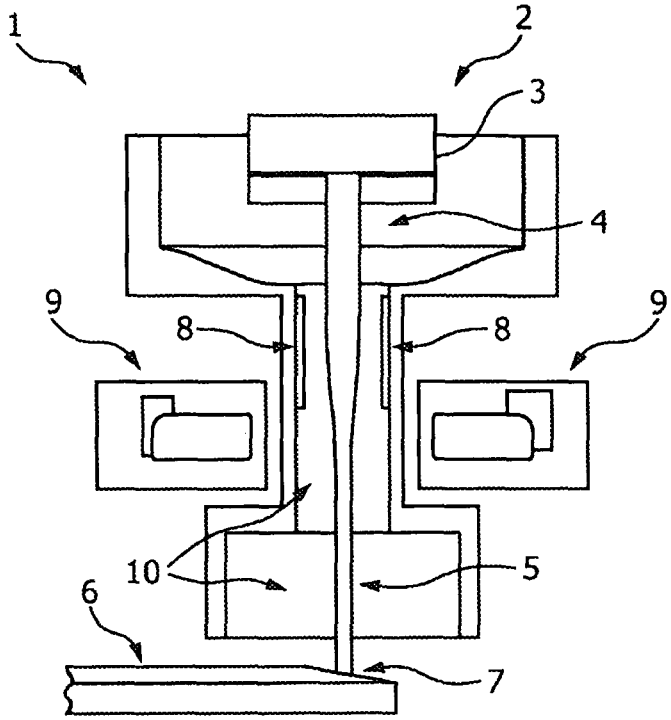

X-RAY TUBE AND METHOD OF VOLTAGE SUPPLYING OF AN ION DEFLECTING AND COLLECTING SETUP OF AN X-RAY TUBE

The present invention relates generally to the technical field of X-ray tubes with a single pair of electrodes, and particularly to the voltage supply of the ion-deflecting and collecting setup (IDC) and to the method for controlling and providing voltage potential for the IDC. More particularly, the invention relates to an X-ray tube with a cathode, generating an electron beam and an ion-deflecting and collecting setup (IDC) consisting of a single pair of electrodes and a method of voltage supplying of an deflecting and collecting setup consisting of a single pair of electrodes. The invention would be applicable to any field in which an ion bombardment onto an electron-emitting device has to be avoided in order to maintain a steady state.

Conventional X-ray tubes comprise at least two separated electron emitter. Due to the small distance between cathode and anode in these tubes, no beam shaping lenses are realizable. Only the cathode cup has influence on the focal spot size and shape. Within the cathode cup the emitters are geometrically separated and, consequently, not inline with the optical axis. Therefore, each emitter produces only one focal spot.

High-end and future X-ray tube generations need to provide the possibility of a variable focal spot size and shape. In comparison to conventional X-ray tubes and in-between different beam shaping lenses, theses tubes have a larger distance between cathode and anode. To achieve optimal focusing properties, it is necessary to place the electron emitter on the optical axis of the lens system. Due to the imperfect vacuum inside the tube, atoms and molecules of the residual gas can be ionised and therefore be influenced by the high voltage and/or by the electro-magnetic and electro-static lenses of the optical system. Some of these ions are accelerated towards the electron emitter. The optical systems focus these ions which then impinge onto the surface of the emitter in a small spot. This could damage the emitter structure and hence reduces the lifetime or lead to an immediate failure. In particular, systems with a high voltage acceleration region and a following electrical field-free region are characterised by this behaviour.

A proposal of an emitter design with a hole in the centre may solve this problem and is described generally in U.S. Pat. No. 5,343,112 and DE 100 20 266 A 1. The ions focused onto the emitter centre travel through this hole and impinge on a more massive structure than the emitter. Due to the higher thermal capacity, the release energy leads to a smaller temperature increase and hence to no damage.

An emitter design with a hole in the centre suffers from the non-electron-emitting area in the centre. It negatively influences the electron optics and leads to an inhomogeneous intensity distribution in the focal spot. Accordingly, the smallest focal spot possible for a homogeneous emission and the used electron-optical setup could no longer be reached.

Another possibility to reduce is the arrangement of multiple electro-static lenses (ion-clearing electrodes ICE), positioned along the optical axis, each built up of two electrodes positioned symmetrically relative to the optical axis. One of each electrode pair is on ground, the other one on negative potential. This is generally described in U.S. Pat. No. 4,521,900, which is regarded as the next-coming state of the art. In case of space restrictions, it is not possible to implement an arrangement of multiple electro-static lenses with different negative voltages, as presented in U.S. Pat. No. 4,521,900

Furthermore, in U.S. Pat. No. 5,193,105 and U.S. Pat. No. 4,625,150 a multi-electrode setup (multi-ICE) is described consisting of at least two pairs (four electrodes) for producing a rotating or transverse electrical field trapping the ions.

But by using only one of these elements within a tube with a field-free region, more ions out of the field-free region are accelerated towards the negative electrode and enter the high-voltage region. These ions are focused and impinge on the emitter. Therefore, a setup comprising only one pair with one electrode on ground and one on negative potential increases the number of ions impinging on the emitter.

Furthermore, both setups using electrodes need more than one voltage source which hence increases the necessary space and mass. This may lead to gantry implementation problems.

In summary, there may be a need for an X-ray tube and a method to avoid ion bombardment on and, hence, damage of the emitter and to overcome the described disadvantages of the above-mentioned X-ray tubes and methods.

The disadvantages may be overcome by an X-ray tube according to claim 1 and a method according to claim 7. The invention includes a principle geometrical setup of the inventive X-ray tube and a preferred operation mode of a single ion-collector or an IDC especially for high-end X-ray tubes including an electrical field-free region.

The ion-collector or the IDC can be driven actively or by a combined active and passive voltage source in order to produce an electrical dipole field necessary for the deflection and collection of positive ions. This may avoid ion bombardment on and, hence, damage of the emitter.

In case of the active/passive voltage supply, the passive voltage source is given by the electrons backscattered from the anode and charging a floated electrode. To achieve a defined potential, the floated electrode may be connected to ground potential via a Zener or suppressor diode.

In a first setup based on the influence of an electro-static field on charged particles, the present invention preferably uses only one pair of electrodes (two electrodes in comparison to the minimal number of four electrodes claimed in U.S. Pat. No. 5,193,105) with opposite potential on each electrode and only the envelope, particularly the X-ray tube on ground potential. This may lead to a significant reduction of ions impinging on the emitter, in comparison to a single element ICE. To provide the opposite voltages, only two sources are necessary.

In a second setup of the invention, it is furthermore possible to eliminate the negative voltage source by carrying on the electro-static ion-deflector/collector principle and by replacing the negative active voltage source by a passive setup. It consists of an electrode which is quasi-floated and a passive electronic component, particularly at least a suppressor diode or Zener diode with a breakdown voltage equivalent to the opposite voltage of the positive electrode potential in order to achieve a symmetrical electrical field. The necessary electrical charge on the negative electrode will be generated by means of scattered electrons which travel on nearly straight lines within the electrical field-free region and hit this electrode.

Other features and advantages of the invention become apparent from the following description in which the preferred embodiments are set forth in detail in conjunction with the accompanying drawings.

Figure 2A:
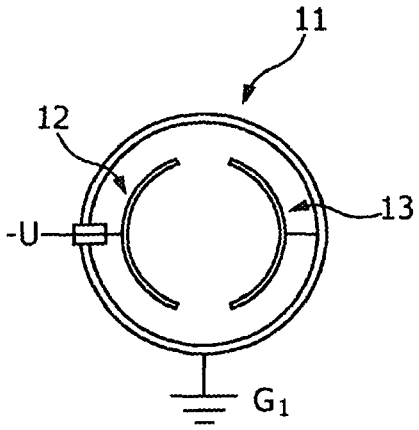
Figure 2B:
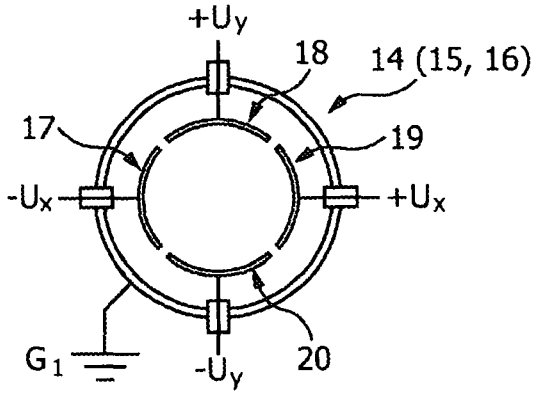
Figure 4:
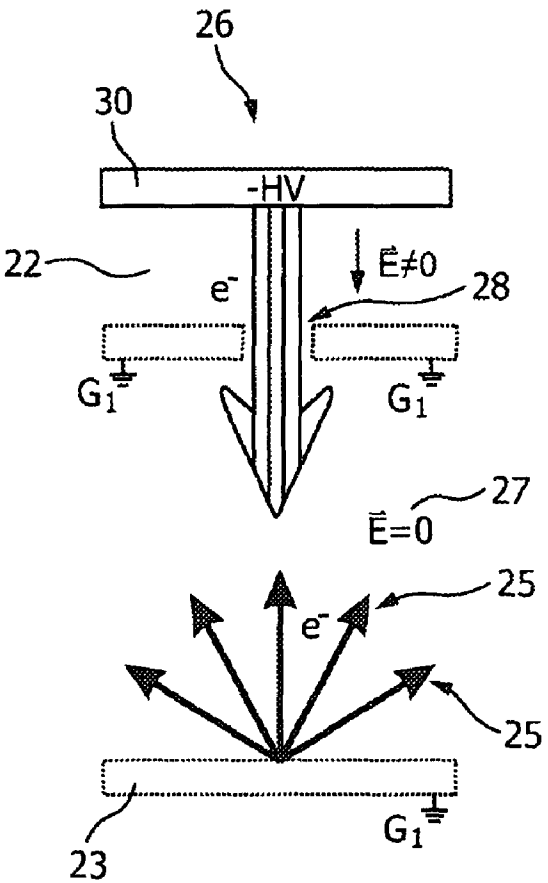
Figure 3:
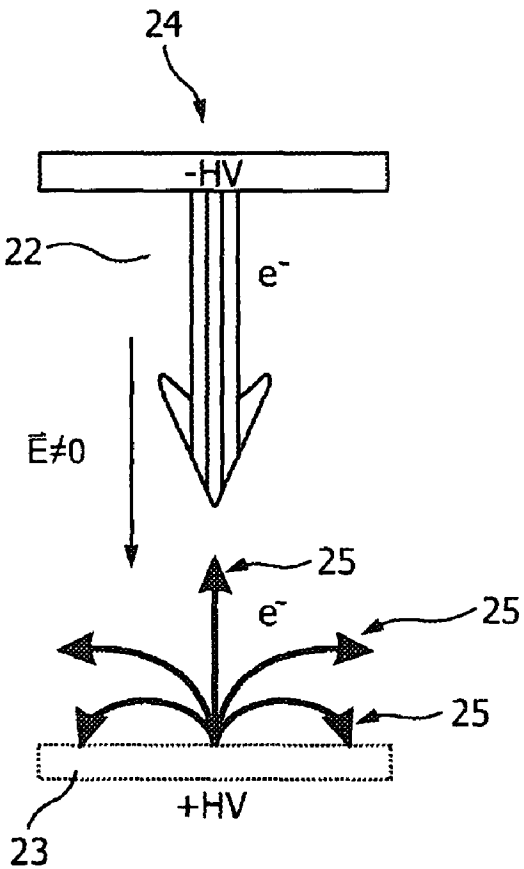
Figure 5B:
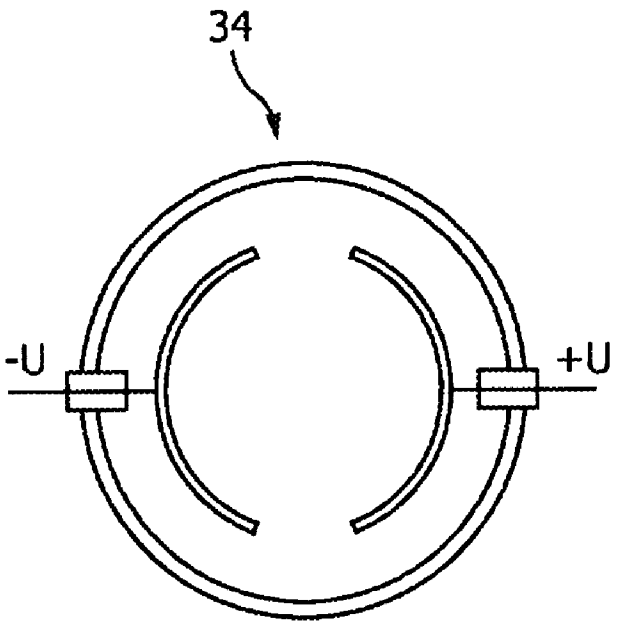
Figure 5A:
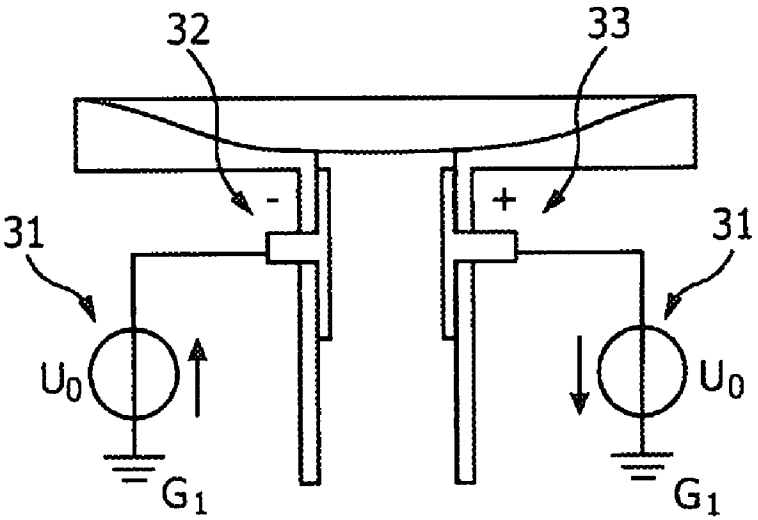

FIG. 1 depicts a generalised prior art X-ray tube with which the present invention may be practiced, FIG. 2 A) is a cross-section perpendicular to the optical axis, showing a prior art ion-controlling electrode setup (ICE) with a first electrode on negative voltage potential and the second on ground potential, FIG. 2 B) is a cross-section perpendicular to the optical axis, showing a prior art four-electrode setup for producing a rotating or transverse electrical field, FIG. 3 depicts a generalised bipolar tube, FIG. 4 depicts a generalised unipolar tube, FIG. 5 A) depicts a cross-section in the optical axis plane of a generalised setup of an active voltage supply for both electrodes of the IDC and FIG. 5 B) illustrates the setup according to FIG. 5 A) shown perpendicular to the optical axis, FIG. 6 depicts simulated ion tracks within the tube shown in FIG. 1:

A) without activated IDC,

B) with one electrode on ground and the other on negative potential and

C) both electrodes on opposite potential and only the tube envelope on ground potential.

Figure 7A:
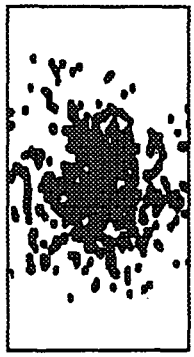
Figure 7B:
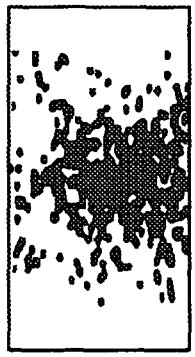
Figure 7C:
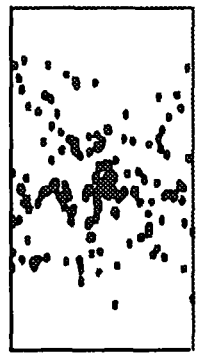
Figure 8:
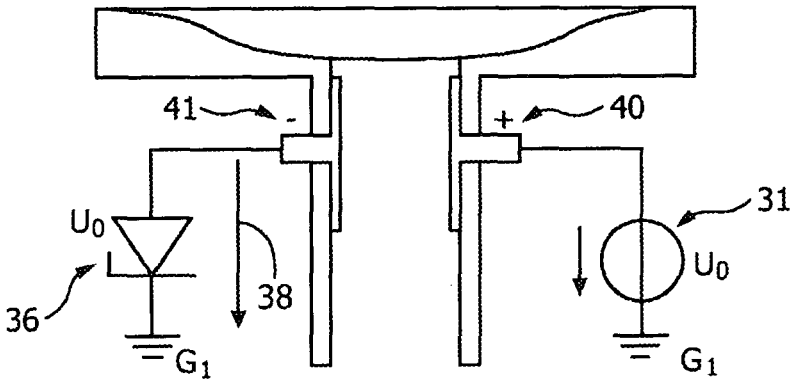
Figure 9:
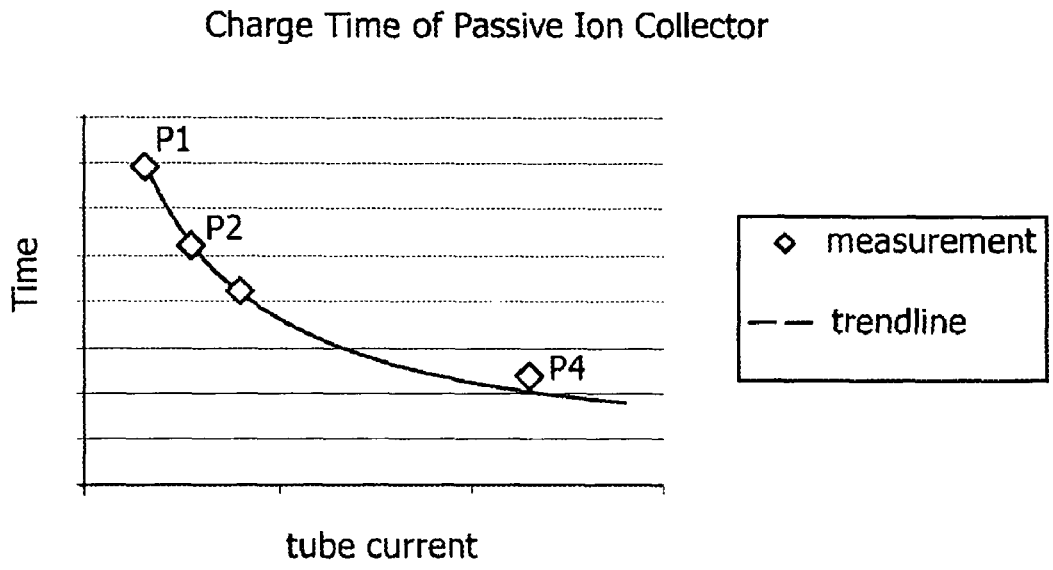
Figure 10:
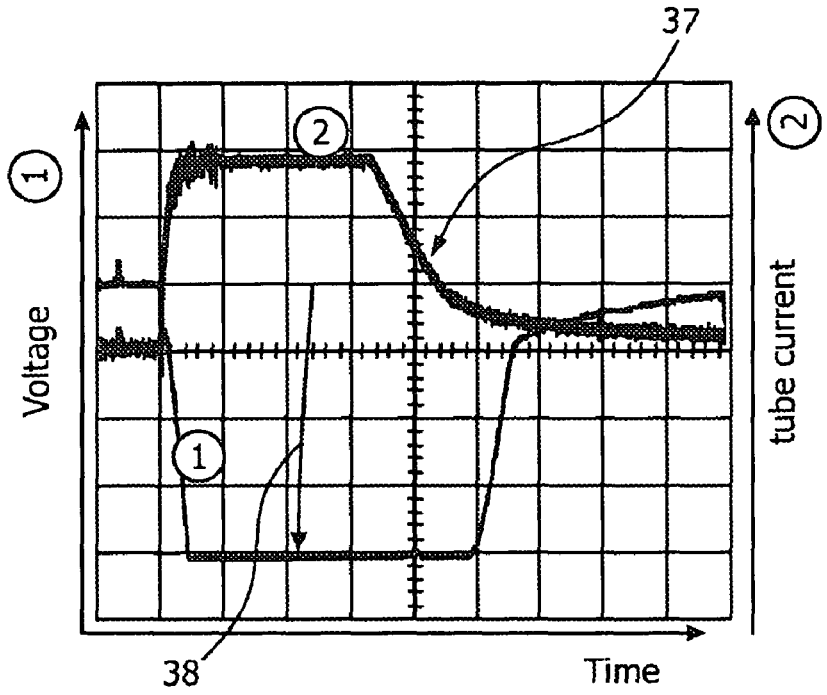

FIG. 7 depicts a simulated focal spot of the ions on an emitter a) without IDC (100% ions), b) with IDC-mode with one electrode on ground and the other on negative voltage (105% ions) and c) with IDC-mode with both electrodes on opposite potential and only a tube envelope on ground potential (16% ions), FIG. 8 shows a generalised setup of a passive negative electrode with a suppressor diode, FIG. 9 is a diagram of the charging time of a passive electrode depending on the tube current (points P1-P4) up to a suppressor diode breakdown voltage of some hundred Volt for the design setup presented in FIG. 1, FIG. 10 is a diagram of the voltage on passive negative electrode (1) and the tube current (2) versus time.

The well-known prior art setup of an X-ray tube 1 presented in FIG. 1, with which the present invention may be practiced, shows a cathode 2 with a cathode cup 3 that generates a high-voltage region 4, in particular an electron beam 5 extending from the cathode cup 3 to an anode disc 6 of the anode not explicitly shown. The electron beam 5 forms a focal spot 7 on the anode disc 6. The electron beam 5 is symmetrically surrounded by an ion deflector/collector (IDC) 8 which deflects and collects ions coming out of the electron beam 5, and further by "optical" lenses 9 that focus the electron beam 5 to the said focal spot 7. After the electron beam 5 has passed the IDC 7, an electric field-free region 10 is reached.

The cross-section illustrated in FIG. 2 A) is perpendicular to the optical axis of a prior art ion-controlling electrode setup (ICE) 11 with one electrode 12 on negative voltage potential −U and the other electrode 13 on ground potential G.

FIG. 2 B) depicts a prior art four-electrode setup 14 for producing a rotating or transverse electrical field. The possibility to reduce ions is here provided by the arrangement of the multiple electro-static lenses 15, 16 (ion-clearing electrodes ICE) positioned along the optical axis of the electron beam, each built up of two electrodes 17, 18, 19, 20 positioned symmetrically relative to the optical axis.

FIG. 3 shows a bipolar tube 24 of the prior art. Here, backscattered electrons 25 within an electrical high-voltage field 22 are reaccelerated towards an anode 23. The future demands on high-end CT and CV X-ray tubes are higher power and smaller focal spots, in addition to an active size and a position control. One key to reach higher power is provided by using an optimised heat management concept inside the X-ray tube 24. In conventional X-ray tubes 24, as shown in FIG. 3, a bipolar high voltage source is used with the anode 23 on positive high voltage potential +HV. Therefore, the electrons 25 backscattered from the anode 23 are reaccelerated towards the anode 23 and, hence, nearly 90-95% of the entire tube power is applied to the anode 23.

FIG. 4 shows a unipolar tube 26. The backscattered electrons 25 within the electrical field-free region 27 travel uninfluenced on straight lines (arrows). The unipolar setup could be used to increase the tube power with one high voltage supply. The high voltage potential −HV penetrates into the virtually field-free region 27, depending on the diameter of the hole opening through a hole 28 within the electrical anode 23. The backscattered electrons 25 travel on almost straight lines in this region and hit special heat-managing tube components dissipating the power (not shown here). In this way, about 40% of the power is dissipated from the target, and a higher tube power is possible without overloading the target. However, such a unipolar setup requires a larger distance between cathode 30 and anode 23 and subsequently a better optical lens system. Atoms and molecules of the residual gas within the tube 26 could be ionised by the scattered electrons 25 and are accelerated by the weak electrical field which penetrates through the anode opening. These ions are focused on the emitter by means of the optical lens system and the space charge of the electron beam and damage or completely destroy the emitter.

FIG. 5 shows a setup of an active voltage supply 31 for both electrodes 32, 33 of the IDC, according to the present invention. FIG. 5 A) depicts a cross-section 34 in the optical axis plane, and FIG. 5 B) depicts a cross section 35 perpendicular to the optical axis of the electron beam. By using an electrical dipole with one negative voltage potential −U and one positive voltage potential +U in comparison to ground potential G, as shown in FIG. 5, nearly all ions can be deflected or collected in order to maintain the emitter's function. The resulting electrical field of this ion-deflector and collector (IDC) influences the ions which then hit the IDC. A few ions hit the cathode cup but not the emitter.

FIG. 6 shows simulated ion tracks within a tube as presented in FIG. 1. FIG. 6 A) is a track without activated IDC. FIG. 6 B) is a track with one electrode on ground potential G and the other on negative voltage potential −U. FIG. 6 C) is a track with both electrodes on opposite potential and with only the tube envelope on ground potential G. The different influence on the ion tracks, especially on those close to the electrodes, of a tube with an ICE and a tube without ion-controlling is made evident here.

FIG. 7 *a*) shows a first simulated focal spot of the ions on the emitter without IDC (100% ions), according to FIG. 6 A).

FIG. 7 *b*) is the simulated spot with IDC-mode with one electrode on ground potential G and the other on negative voltage potential −U (105% ions), according to FIG. 6 B), and FIG. 7 *c*) shows the simulated spot with IDC-mode with both electrodes on opposite potential and with only the tube envelope on ground potential G (16% ions), according to FIG. 6 C).

The resulting ion bombardment density for a tube setup as shown in FIG. 1 and e.g. an $U_{IDC}$ of plus/minus some hundred Volt is presented in FIG. 7. This reduces the ion intensity to 16% (FIG. 7 *c*)), compared to 100% without IDC (FIG. 7 *a*)). Experimental results show that this reduction significantly decreases the emitter damage and thus increases the lifetime.

Figures 6A, 6B, 6C:
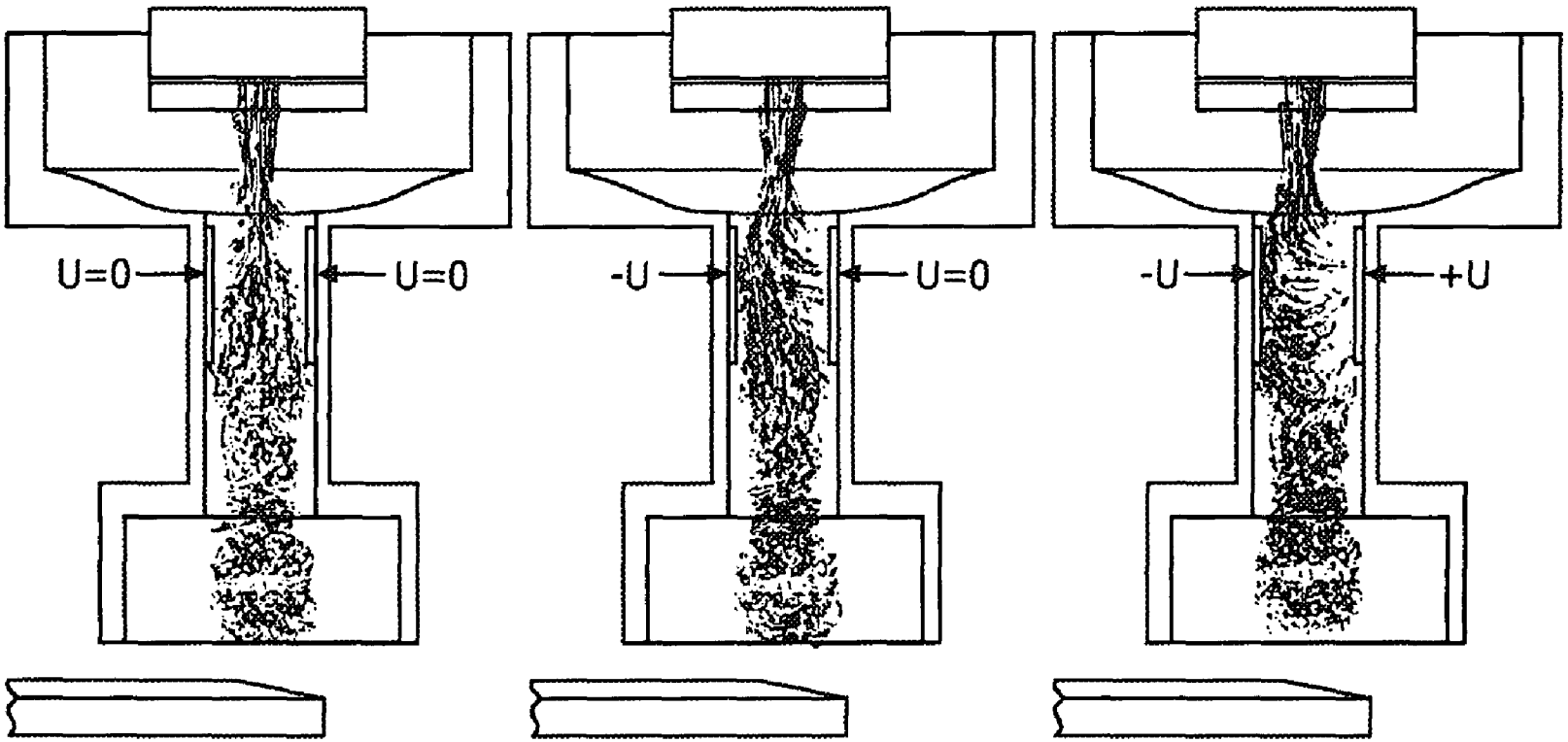

By using only one IEC (negative potential), as explained above, more ions than without ion-controlling hit the emitter (105% ion intensity) (FIG. 7 *b*). In principle, this behaviour is given by the accelerating influence of the negative electrode on the ions and the subsequent injection into the high voltage region (FIGS. 6*b* and 7*b*). In this case, this results in only a slight defocusing and deflection of the ions.

The influence of an IDC with e.g. an $U_{IDC}$ of plus/minus some hundred Volt on the accelerated fast electrons is of only minor effect.

FIG. 8 depicts a simple setup, according to the present invention of a passive negative electrode with a suppressor diode 36 or a Zener diode. Both effects mentioned above, i.e. the straight-line-travelling within the field-free region and the IDC-function, can be combined with this setup. If an electrode is not connected to ground potential G, scattered electrons hit it and the surface is charged with negative voltage potential –U. By choosing an adequate diode corresponding to the desired application voltage for the positively charged electrode, a well-defined and functional active/passive IDC is given.

In FIG. 9, it is illustrated how fast the negative electrode is charged up to minus some hundred Volt which is sufficient for the IDC to run well in a setup similar to that shown in FIG. 1. The charging time of a passive electrode depends on the tube current (points P1-P4) up to the suppressor diode breakdown voltage 38 of some hundred Volt for the design setup presented in FIG. 1. The charging time is approximately proportional to the reciprocal tube current. It takes some milliseconds for a given tube current which decreases for a greater current. The deviation of the latter value to the assumed curve can be explained by an imperfect rising edge of the tube current (FIG. 10, curve 37). It takes a few milliseconds to reach the desired tube current (see FIG. 10). The necessary charging time will be smaller for steeper rising edges. Due to the short charging times in relation to the X-ray exposure times, the functionality of the active/passive IDC is not significantly reduced.

Furthermore, the positive and, hence, deflecting electrode 40 is active during the entire shoot. As a result, the proposed combination of the active and passive voltage supply, as shown in FIG. 8 for the IDC, is sufficient for every kind of X-ray application.

The explanations given above result particularly in the following setup proposals:

In a first setup of the invention, as a single ion-collector/deflector (IDC) for X-ray tubes with an electrical field-free region, based on the electro-static dipole influence on charged particles with only two electrodes on opposite electrical potential and active voltage supplies.

In a second setup of the invention, as a setup with the negative electrode 41 realised as a passive one, charged by scattered electrons and a voltage limitation by a passive electronic component, e.g. a Zener diode or a suppresser diode 36.

The invention is not limited in its implementation to the preferred embodiments shown in the figures. Rather, a plurality of variants is conceivable, which make use of the described solution and inventive principle, even in fundamentally differently configured embodiments.

Let it additionally be noted that "comprising" does not preclude any other elements or steps, and "one" or "a" do not preclude a plurality. Further, let it be noted that features or steps that were described with reference to one of the above exemplary embodiments may also be used in combination with other features or steps in other exemplary embodiments described above. Reference numbers in the claims are not to be regarded as limiting.

The invention claimed is:

1. An X-ray tube comprising:

a cathode for generating an electron beam; and an ion-deflecting and collecting setup comprising a single pair of electrodes, a first electrode of said pair having a positive voltage potential, compared to ground potential.

2. The X-ray tube according to claim 1, said setup comprising a voltage supply to which said the first electrode is connected.

3. X-ray tube according to claim 1, a second electrode of said pair having negative voltage potential, compared to said ground potential.

4. The X-ray tube according to claim 3, said setup comprising a second voltage supply to which said second electrode is connected.

5. The X-ray tube according to claim 3, said setup comprising an electric passive device to which said second electrode is connected, said electric passive device comprising at least one electronic component.

6. The X-ray tube according to claim 5, said passive device comprising a suppressor diode.

7. An X-ray device comprising an X-ray tube according to claim 1.

8. The X-ray tub of claim 1, said setup comprising a plurality of electrodes, said plurality amounting to two electrodes, said two electrodes together constituting said single pair.

9. The X-ray tube of claim 1, said setup being distinct from any system for controlling a spot on an anode by at least one of steering, and focusing, said beam.

10. A method for reducing an effect of ions formed during operation of an electron-emitting device comprising:

to implement an ion-deflecting and -collecting setup comprising a plurality of electrodes, said plurality comprising only one pair of electrodes, providing a first electrode of said pair with a positive voltage potential compared to ground potential, to thereby afford said reducing.

11. The method according to claim 10, comprising providing a second electrode of said pair with a negative voltage potential, compared to said ground potential.

12. The method according to claim 10, said setup comprising a voltage supply.

13. The method according to claim 11, wherein the negative voltage potential is provided by electrons of an electron beam emitted by said device that have been scattered and is limited by an electric passive device comprising at least one electronic component.

14. The method according to claim 13, wherein the passive device comprises a suppressor diode.

15. The method of claim 10, further comprising disposing said setup between said device and a system for controlling a spot on an anode by at least one of steering, and focusing, a beam emitted by said device.

16. The method of claim 10, said positive voltage potential of said first electrode remaining fixed throughout operation of said pair.

17. The method of claim 10, said setup comprising a plurality of electrodes, said plurality amounting to two electrodes, said two electrodes together constituting said only one pair.

18. The method of claim 10, said setup being distinct from any system for controlling a spot on an anode by at least one of steering, and focusing, an electron beam emitted by said device.

19. An X-ray tube comprising:

a cathode for emitting an electron beam; and a device configured for deflecting, and collecting, ions so as to mitigate what would otherwise be an effect of said ions, said device being distinct from any system for controlling a spot on an anode by at least one of steering, and focusing, said beam, said device comprising a single pair of electrodes, an electrode of said pair having a positive voltage potential, compared to ground potential.

20. The X-ray tube of claim 19, further comprising said system.

21. The X-ray tube of claim 20, said device being disposed between said cathode and said system.

22. The X-ray tube of claim 15, configured such that the other electrode of said pair is given a negative voltage potential by backscattered electrons.

23. The X-ray tube of claim 19, configured such that said voltage potential of said electrode remains positive throughout operation of said device.

24. The X-ray tube of claim 19, configured as a unipolar tube.

25. The X-ray tube of claim 19, said device comprising a plurality of electrodes, said plurality amounting to two electrodes, said two electrodes together constituting said single pair.

26. The X-ray tube of claim 19, said device further comprising a voltage supply to which said electrode is connected.

* * * * *